US010593293B2

(12) United States Patent
Li

(10) Patent No.: US 10,593,293 B2
(45) Date of Patent: Mar. 17, 2020

(54) DISPLAY DEVICE AND BACKLIGHT DRIVING METHOD THEREOF

(71) Applicant: Wistron Corp., New Taipei (TW)

(72) Inventor: Yong Qiang Li, New Taipei (TW)

(73) Assignee: WISTRON CORP., New Taipei (TW)

( * ) Notice: Subject to any disclaimer, the term of this patent is extended or adjusted under 35 U.S.C. 154(b) by 107 days.

(21) Appl. No.: 15/855,498

(22) Filed: Dec. 27, 2017

(65) Prior Publication Data

US 2019/0080669 A1 Mar. 14, 2019

(30) Foreign Application Priority Data

Sep. 12, 2017 (CN) ..... 2017 1 0817587

(51) Int. Cl.
*G09G 5/10* (2006.01)
*G09G 3/34* (2006.01)
*G09G 3/36* (2006.01)

(52) U.S. Cl.
CPC ..... *G09G 5/10* (2013.01); *G09G 3/342* (2013.01); *G09G 3/36* (2013.01); *G09G 2320/062* (2013.01); *G09G 2330/045* (2013.01); *G09G 2360/16* (2013.01)

(58) Field of Classification Search
CPC ..... G09G 5/10; G09G 3/342; G09G 3/3412; G09G 3/36; G09G 3/2007; G09G 3/20; G09G 3/3607
USPC ..... 345/690
See application file for complete search history.

(56) References Cited

U.S. PATENT DOCUMENTS 7,293,907 B2 * 11/2007 Kim ..... G02F 1/133603 257/E25.02
8,259,258 B2 * 9/2012 Gorog ..... G02F 1/133621 349/70
9,171,509 B2 * 10/2015 McRae ..... G09G 3/3607
9,829,710 B1 * 11/2017 Newell ..... G02B 27/0172
10,120,267 B2 * 11/2018 Bonnier ..... G03B 15/07
2007/0187511 A1 * 8/2007 Meffre ..... G01J 3/50 235/462.04
2008/0165103 A1 * 7/2008 Lee ..... G09G 3/3607 345/88
2008/0198114 A1 * 8/2008 Roberts ..... G09G 3/3413 345/88
2009/0278774 A1 11/2009 Chen et al.
2010/0026722 A1 * 2/2010 Kondo ..... G09G 3/2007 345/660

(Continued)

*Primary Examiner* — Fred Tzeng

(57) ABSTRACT

A display device is provided. The display device includes a display panel, a backlight controller, a light source module, and an image processor circuit. The display panel is divided into display regions. The backlight controller generates driving signals according to control signals. The light source units in the light source module are controlled respectively by the driving signals to emit light. The image processor circuit generates the control signals according to input image data. The image processor circuit obtains a respective estimated current according to the sum of first and second color brightness gains of the pixel cells in each display region and further determines an adjustment factor according to the sum of all the estimated currents. When the backlight controller operates in a high brightness mode, the image processor circuit changes the control signals according to the adjustment factor, thereby adjusting the driving signals.

20 Claims, 3 Drawing Sheets

(56) References Cited

U.S. PATENT DOCUMENTS

| | | | | |
|---|---|---|---|---|
| 2010/0060820 | A1* | 3/2010 | Kleppinger | G02F 1/133621 349/68 |
| 2010/0123839 | A1* | 5/2010 | Lu | G02B 27/2264 349/15 |
| 2010/0165001 | A1* | 7/2010 | Savvateev | G09G 3/3413 345/690 |
| 2010/0188526 | A1* | 7/2010 | Origuchi | H04N 5/2351 348/229.1 |
| 2010/0208041 | A1* | 8/2010 | Savvateev | G02B 27/2207 348/51 |
| 2011/0109611 | A1* | 5/2011 | Nakamura | G09G 3/20 345/211 |
| 2011/0134021 | A1* | 6/2011 | Schmitz | H05B 33/0827 345/83 |
| 2014/0063074 | A1 | 3/2014 | Drzaic | |

* cited by examiner

DISPLAY DEVICE AND BACKLIGHT DRIVING METHOD THEREOF

CROSS REFERENCE TO RELATED APPLICATIONS

This application claims priority of China Patent Application No. 201710817587.9, filed on Sep. 12, 2017, the entirety of which is incorporated by reference herein.

BACKGROUND

Field

The disclosure relates to a display device, and more particularly to a display device performing a backlight driving method to provide backlight with high brightness.

Description of the Related Art

With the development of technology for image capture and display, high dynamic range imaging (HDR) technology is not only used for image capture but also gradually applied to displayers. According to the specification of the HDR technology, a panel of a displayer must support high brightness, high contrast, and local dimming to enhance the brightness and detail of the frames to provide the user with better viewing experience. In general, a backlight module of a display panel needs to be driven by a large driving current to achieve high brightness. However, driving a backlight module with a large driving current may cause a thermal problem (for example, overheating), resulting in a limited designs for the displayer, reduced safety for use, and the like.

BRIEF SUMMARY

Thus, the present disclosure provides a display device in which a backlight module can determine a driving current for the backlight module according to the received input image data thereby maximizing the brightness, so as to improve the image quality and prevent the display device from overheating.

An exemplary embodiment of a display device is provided. The display device includes a display panel, a backlight controller, a light source module, and an image processing circuit. The display panel includes a plurality of pixel units. The display panel is divided into a plurality of display areas. The backlight controller receives a plurality of control signals and generates a plurality of driving signals according to the plurality of control signals respectively. The light source module includes a plurality of light source units corresponding to the plurality of display areas respectively. The light source units are controlled respectively by the plurality of driving signals to emit light. The image processing circuit receives input image data and generates the plurality of control signals according to the input image data. The input image data includes a first color brightness gain and a second color brightness gain of each pixel unit. For each of the plurality of display areas, the image processing circuit obtains an estimated current according to a sum of the first color brightness gains and the second color brightness gains of the pixel units in the display area. The image processing circuit decides an adjustment factor according to a sum of the estimated currents of all of the plurality of display areas. When the backlight controller operates in a high brightness mode, the image processing circuit changes the plurality of control signals according to the adjustment factor, thereby adjusting the plurality of driving signals.

An exemplary embodiment of a backlight driving method for a display device is provided. The display device includes a display panel and a backlight module. The display panel includes a plurality of pixel units and is divided into a plurality of display areas. The light source module includes a plurality of light source units corresponding to the plurality of display areas. The backlight driving method includes the following steps of receiving input image data, wherein the input image data includes a first color brightness gain and a second color brightness gain of each pixel unit; obtaining an estimated current according to a sum of the first color brightness gains and the second color brightness gains of the pixel units in each of the plurality of display area; deciding an adjustment factor according to a sum of the estimated currents of all of the plurality of display areas; for each light source unit of the backlight module, generating a driving signal according to the corresponding estimated current to drive the light source unit to emit light; and in a high brightness mode, for each of the plurality of light source units, adjusting the corresponding driving signal and driving the light source unit by the adjusted corresponding driving signal to emit light.

A detailed description is given in the following embodiments with reference to the accompanying drawings.

BRIEF DESCRIPTION OF THE DRAWINGS

The disclosure can be more fully understood by reading the subsequent detailed description and examples with references made to the accompanying drawings, wherein.

DETAILED DESCRIPTION

The following description is of the best-contemplated mode of carrying out the invention. This description is made for the purpose of illustrating the general principles of the invention and should not be taken in a limiting sense. The scope of the disclosure is best determined by reference to the appended claims.

Figure 1:
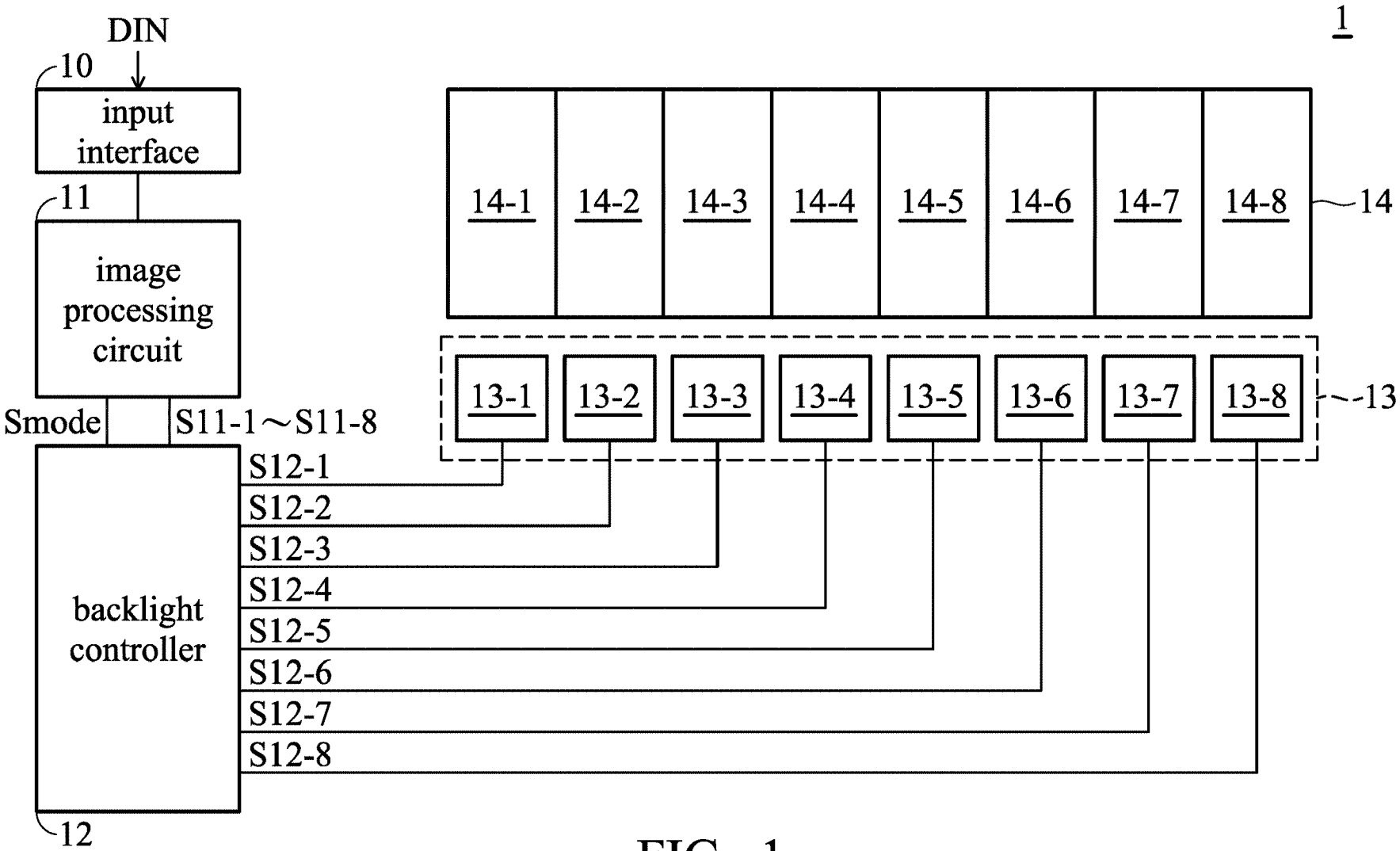
FIG. 1 shows an exemplary embodiment of a display device.

FIG. 1 shows an exemplary embodiment of a display device. Referring to FIG. 1, the display device 1 includes an input interface 10, an image processing circuit 11, a backlight controller 12, a backlight module 13, and a display panel 14. The display device 1 receives input image data DIN through the input interface 10. The input interface 10 may be a video graphics array (VGA), a digital video interface (DVI), or a high definition multimedia interface (HDMI). The backlight module 13 is controlled by the backlight control circuit 12 to emit light to the display panel 14. In the embodiment, the backlight module 13 includes a plurality of light source units. In the following, eight light source units 13-1~13-8 are given as an example for illustration. Based on the configuration of the eight light source units 13-1~13-8, the backlight control circuit 12 generates eight driving signals S12-1~S12-8 to drive the light source units 13-1~13-8 to emit light, respectively. The brightness of the light emitted by the light source units 13-1~13-8 is determined by the intensity of the driving signals S12-1~S12-8, the frequencies of the driving signals S12-1~S12-

8, or the combination of the intensity and the frequencies of the driving signals S12-1~S12-8. In the embodiment, the driving signals S12-1~S12-8 are implemented as currents (the driving signals S12-1~S12-8 may also be referred to as driving currents). The display panel 14 includes a plurality of pixel units. In addition, the display panel 14 is divided into eight display areas 14-1~14-8 corresponding to the positions where the light rays from the light source units 13-1~13-8 arrive, and the display areas 14-1~14-8 correspond to the light source units 13-1~13-8 respectively. That is, the pixel units of the display panel 14 are divided into eight groups and located in the display areas 14-1~14-8, respectively. In an embodiment, the backlight module 13 is a direct light source of the display panel 14 and is disposed directly below the display panel 14. In another embodiment, the backlight module 13 is a side-edge light source of the display panel 14 which is disposed on one side of the display panel 14 and provides the light to the display panel 14 through a light guide plate. In this case, each light source unit includes a light bar. In an embodiment, each light bar may include at least one lamp or a light emitting diodes (LEDs) arranged in an array.

The image processing circuit 11 generates a plurality of control signals S11-1~S11-8 provided to the backlight controller 12 according to the received input image data DIN, and the backlight controller 12 generates the driving signals S12-1~S12-8 according to the control signals S11-1~S11-8 respectively. In the embodiment, the backlight controller 12 can selectively operate in a normal brightness mode or a high brightness mode. The switching of the brightness modes of the backlight controller 12 is controlled by a mode signal Smode which is generated by the image processing circuit 11 according to the input image data DIN.

In one embodiment, the components which are used in the image processing circuit 11 to generate the control signals S11-1~S11-8 and the mode signal Smode to control the brightness and the switching of brightness modes may include electronic circuits specific for its purpose. In one example, at least one component of the image processing circuit 11 may be implemented as a processor to perform the functions described herein. For example, the processor may include at least one specific-purpose element or may include a programmable logic gate for implementing the functions described herein. The processor can operate in an analog domain, a digital domain, or a mixed signal domain. In other examples, the processor may be configured to perform the functions described herein by executing at least one indication stored in a non-transitory computer-readable storage medium.

Figure 2:
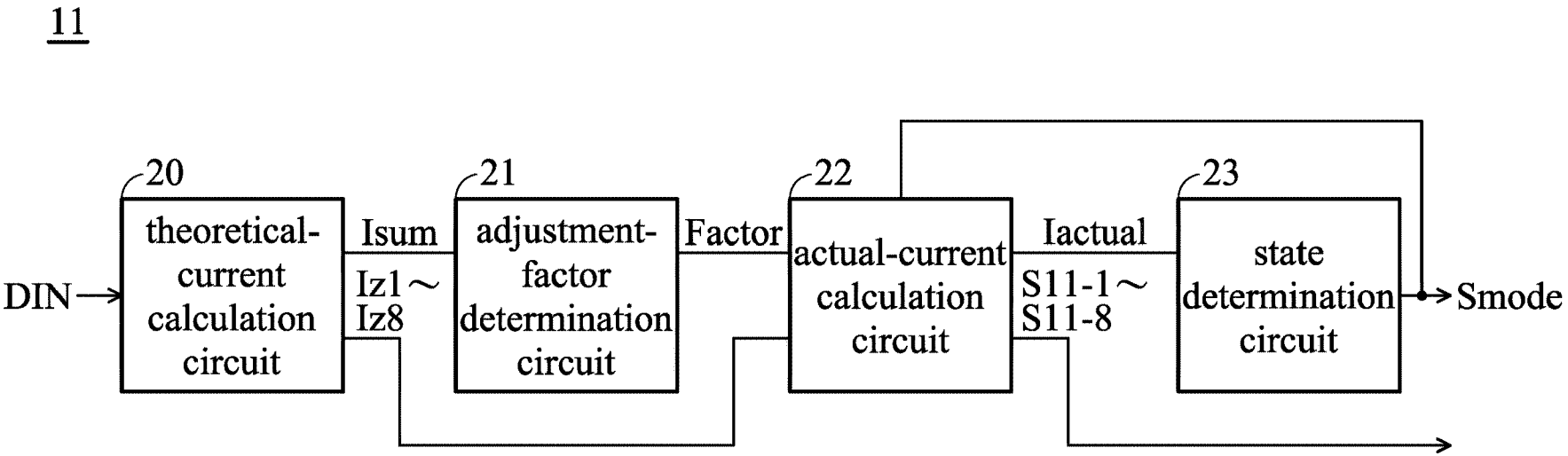
FIG. 2 shows an exemplary embodiment of an image processing circuit.

FIG. 2 shows an exemplary embodiment of the image processing circuit. The detailed operations of the image processing circuit 11, the backlight controller 12, and the backlight module 13 will be described in detail below with reference to FIGS. 1 and 2.

Referring to FIGS. 1 and 2, the image processing circuit 11 includes a theoretical-current calculation circuit 20, an adjustment-factor determination circuit 21, an actual-current calculation circuit 22, and a state determination circuit 23. The theoretical-current calculation circuit 20 receives the input video data DIN through the input interface 10. The content of the input video data DIN includes the brightness gains of a plurality of colors of each pixel unit. For example, the content of the input video data DIN includes a red brightness gain, a green brightness gain, and a blue brightness gain of each pixel unit. The theoretical-current calculation circuit 20 calculates a corresponding estimated current according to the sum of the red brightness gains, the sum of the green brightness gains, and the sum of the blue brightness gains of each display area. In an embodiment, the theoretical-current calculation circuit 20 calculates the estimated current corresponding to each display area according to Formula (1).

$$Izn=(Rzn+Gzn+Bzn)/Wn\times(I\max/N\max) \quad (1)$$

Izn represents the estimated current of the n-th display area among the display areas 14-1~14-8, wherein 1≤n—8. Rzn represents the sum of the red brightness gains of all the pixel units in the n-th display area. Gzn represents the sum of the green brightness gains of all the pixel units in the n-th display area. Bzn represents the sum of the blue brightness gains of all the pixel units in the n-th display area. Wn represents the maximum value (referred to as the maximum gain sum) of the sum of the red brightness gains, the green brightness gains, and the blue brightness gains of one of the display areas 14-1~14-8. In the embodiment, the maximum gain sum is equal to 765 (=255×3). Imax represents the default total current of the backlight module 13. Nmax represents the number of light source units in the backlight module 13 (ie, the number of display areas). In the embodiment, Nmax is equal to 8.

In the embodiment, the sum (that is, Rzn+Gzn+Bzn) of the red brightness gains, the green brightness gains, and the blue brightness gains of one display area are referred to as an area gain sum. In the cases where the backlight module 13 has the default total current Imax, the same default current is assigned to each of the light source units 13-1~13-8 evenly, that is, the default area current of each of the light source units 13-1~13-8 is equal to (Imax/Nmax). Therefore, according to Formula (1), for each display area, the theoretical-current calculation circuit 20 calculates the product of the ratio of the area gain sum (Rzn+Gzn+Bzn) to the maximum gain sum Wn and the default area current (Imax/Nmax) to obtain the corresponding estimated current Izn.

After obtaining the estimated currents of the display areas 14-1~14-8, the theoretical-current calculation circuit 20 calculates the sum of the estimated currents Iz1~Iz8 according to Formula (2) to obtain the theoretical current sum Isum.

$$Isum=Iz1+Iz2+Iz3+Iz4+Iz5+Iz6+Iz7+Iz8) \quad (2)$$

In an embodiment, the theoretical-current calculation circuit 20 includes at least one adder, at least one multiplier, and at least one divider which operate cooperatively to obtain the theoretical current sum Isum.

The theoretical-current calculation circuit 20 transmits the theoretical current sum Isum to the adjustment-factor determination circuit 21 through the transmission of a signal or an instruction. The adjustment-factor determination circuit 21 determines the magnitude of the theoretical current sum Isum to decide an adjustment factor Factor for adjusting the driving currents. In the embodiment, the adjustment-factor determination circuit 21 determines the magnitude of the theoretical current sum Isum based on two reference values. The first reference value is 80% of the default total current Imax (80%×Imax), and the second reference value is 60% of the default total current Imax (60%×Imax).

When it is determined that the theoretical current sum Isum is larger than (80%×Imax), the adjustment-factor determination circuit 21 decides that the adjustment factor Factor has a value of 1 (Factor=1). When it is determined that the theoretical current sum Isum is smaller than (80%×Imax) and larger than (60%×Imax), the adjustment-factor determination circuit 21 decides that the adjustment factor Factor has a value of 1.3 (Factor=1.3). When it is determined that the theoretical current sum Isum is less than (60%×Imax), the adjustment-factor determination circuit 21 decides that the adjustment factor Factor has a value of 1.5 (Factor=1.5). After the value of the adjustment factor Factor is decided, the adjustment-factor determination circuit 21 transmits the adjustment factor Factor to the actual-current calculation circuit 22 through the transmission of a signal or instruction. In an embodiment, the adjustment-factor determination circuit 21 includes at least one comparator, a memory for storing a plurality of values, and a read circuit for reading a value from the memory based on a result of the comparison performed by the comparator, which operate cooperatively to obtain the value of the adjustment factor Factor.

In addition, the theoretical-current calculation circuit 20 transmits the estimated currents Iz1~Iz8 to the actual-current calculation circuit 22 through the transmission of a signal or an instruction. The actual-current calculation circuit 22 calculates an actual current sum Iactual according to the estimated currents Iz1~Iz8 and the adjustment factor Factor. In detail, the actual-current calculation circuit 22 calculates the sum of the products which are obtained by multiplying each of the estimated currents Iz1~Iz8 with the adjustment factor Factor to obtain the actual current sum Iactual, as shown in Formula (3).

$$Iactual=Iz1\times Factor+Iz2\times Factor+Iz3\times Factor+Iz4\times Factor+Iz5\times Factor+Iz6\times Factor+Iz7\times Factor+Iz8\times Factor) \quad \text{Formula (3)}$$

According to the above description, the adjustment factor Factor determines the degree of the adjustment of the estimated currents Iz1~Iz8. In the embodiment, the estimated currents Iz1~Iz8 are adjusted to be the actual currents Iz1'~Iz8' respectively. For example, Iz1'=Iz1×Factor. Since the adjustment factor Factor is greater than or equal to 1, when the estimated currents Iz1~Iz8 are adjusted according to the adjustment factor Factor, the adjusted estimated currents (ie, the actual currents Iz1'~Iz8') are larger compared with the estimated currents Iz1~Iz8.

After obtaining the actual current sum Iactual, the actual-current calculation circuit 22 transmits the actual current sum Iactual to the state determination circuit 23 through the transmission of a signal or an instruction. In addition, the actual-current calculation circuit 22 is controlled by the mode signal Smode to generate the control signals S11-1~S11-8 according to the estimated currents Iz1~Iz8 (not adjusted) or the actual currents Iz1'~Iz8' (adjusted), respectively. The actual-current calculation circuit 22 transmits the control signals S11-1~S11-8 to the backlight controller 12 through the transmission of a signal or an instruction. In an embodiment, the actual-current calculation circuit 22 includes at least one multiplier and at least one adder, which operate cooperatively to obtain the actual current sum Iactual and the actual currents Iz1'~Iz8'.

The state determination circuit 23 determines the magnitude of the actual current sum Iactual to generate the mode signal Smod for controlling the switching of the brightness modes. The mode signal Smod is transmitted to the backlight controller 12 and the actual-current calculation circuit 22 to indicate the switching state of the backlight controller 12. In the embodiment, the state determination circuit 23 determines the magnitude of the actual current sum Iactual according to the reference values (80%×Imax) and (60%×Imax). When the state determination circuit 23 determines that the actual current sum Iactual is larger than (80%×Imax), the state determination circuit 23 generates the mode signal Smod to indicate the first switching state. After the backlight controller 12 receives the mode signal Smode, the backlight controller 12 enters the first switching state. In the first switching state, the backlight controller 12 alternately operates in the normal brightness mode and the high brightness mode. According to one embodiment, in the first switching state, the duration in which the backlight controller 12 operates in the high brightness mode each time is 1 minute, and the duration in which the backlight controller 12 operates in the normal brightness mode each time is 1 minute.

When the state determination circuit 23 determines that the actual current sum Iactual is smaller than (80%×Imax) and larger than (60%×Imax), the state determination circuit 23 generates the mode signal Smod to indicate the second switching state. After the backlight controller 12 receives the mode signal Smode, the backlight controller 12 enters the second switching state. In the second switching state, the backlight controller 12 alternately operates in the normal brightness mode and the high brightness mode. According to one embodiment, in the first switching state, the duration in which the backlight controller 12 operates in the high brightness mode each time is 30 minutes, and the duration in which the backlight controller 12 operates in the normal brightness mode each time is 2 minutes.

When the state determination circuit 23 determines that the actual current sum Iactual is smaller than (60%×Imax), the state determination circuit 23 generates the mode signal Smod to indicate the third switching state. After the backlight controller 12 receives the mode signal Smode, the backlight controller 12 enters the third switching state. In the third switching state, the backlight controller 12 continuously operates in the high brightness mode, and the backlight controller 12 does not switch to the normal brightness mode. In the embodiment, the durations of the high brightness mode in the first to third switching states are gradually increased.

In an embodiment, the status determination circuit 23 includes at least one comparator and a signal generator that operates according to the comparison result of the comparator, which operate cooperatively to obtain the mode signal Smode.

After receiving the mode signal Smode, the backlight controller 12 enters the corresponding switching state according to the mode signal Smode. In addition, the actual-current calculation circuit 22 obtains the switching state which the backlight controller 12 will enter according to the mode signal Smode. In the corresponding state, when the backlight controller 12 operates in the normal brightness mode, the actual-current calculation circuit 22 generates the control signals S11-1~S11-8 respectively according to the estimated currents Iz1~Iz8 (not adjusted) and further according to the mode signal Smode, and the backlight controller 12 generates the corresponding driving signals S12-1~S12-8 according to the control signals S11-1~S11-8, respectively. In cases where the driving signals S12-1~S12-88 are implemented as currents, the backlight controller 12 generates driving currents equal to the estimated currents Iz1~Iz8 as the drive signals S12-1~S12-8 to drive the light source units 13-1~13-8, respectively. Moreover, in the corresponding state, when the backlight controller 12 operates in the high brightness mode, the actual-current calculation circuit 22 generates the control signals S11-1~S11-8 respectively according to the actual currents Iz1'~ Iz8' (adjusted) and further according to the mode signal Smode, and the backlight controller 12 generates the corresponding driving signals S12-1~S12-8 according to the control signals S11-

1~S11-8, respectively. In cases where the drive signals S12-1~S12-8 are implemented as currents, the backlight controller 12 generates driving currents equal to the actual currents Iz1'~Iz8' as the driving signals S12-1~S12-8 to drive the light source units 13-1~13-8, respectively.

According to the above description, when the backlight controller 12 operates in the high brightness mode, the actual-current calculation circuit 22 changes the control signals S11-1~S11-8 according to the adjustment factor Factor, and the backlight controller 12 adjusts the driving signal S12-1~S12-8 according to the changed the control signal S11-1~S11-8. Since the adjustment factor Factor is greater than or equal to 1, the driving signals S12-1~S12-8 (ie, the actual currents Iz1'~Iz8') become larger in the high brightness mode. Therefore, the driven light source units 13-1~13-8 can emit light with higher brightness to meet the requirements of high dynamic range imaging (HDR) technology. In addition, the duration of the high brightness mode may have different lengths depending on the actual current sum Iactual. Therefore, when the display device 1 of the disclosed embodiment supports HDR technology, the problem of thermal (for example, overheating) can be avoided through the proper switching of the brightness modes.

Figure 3:
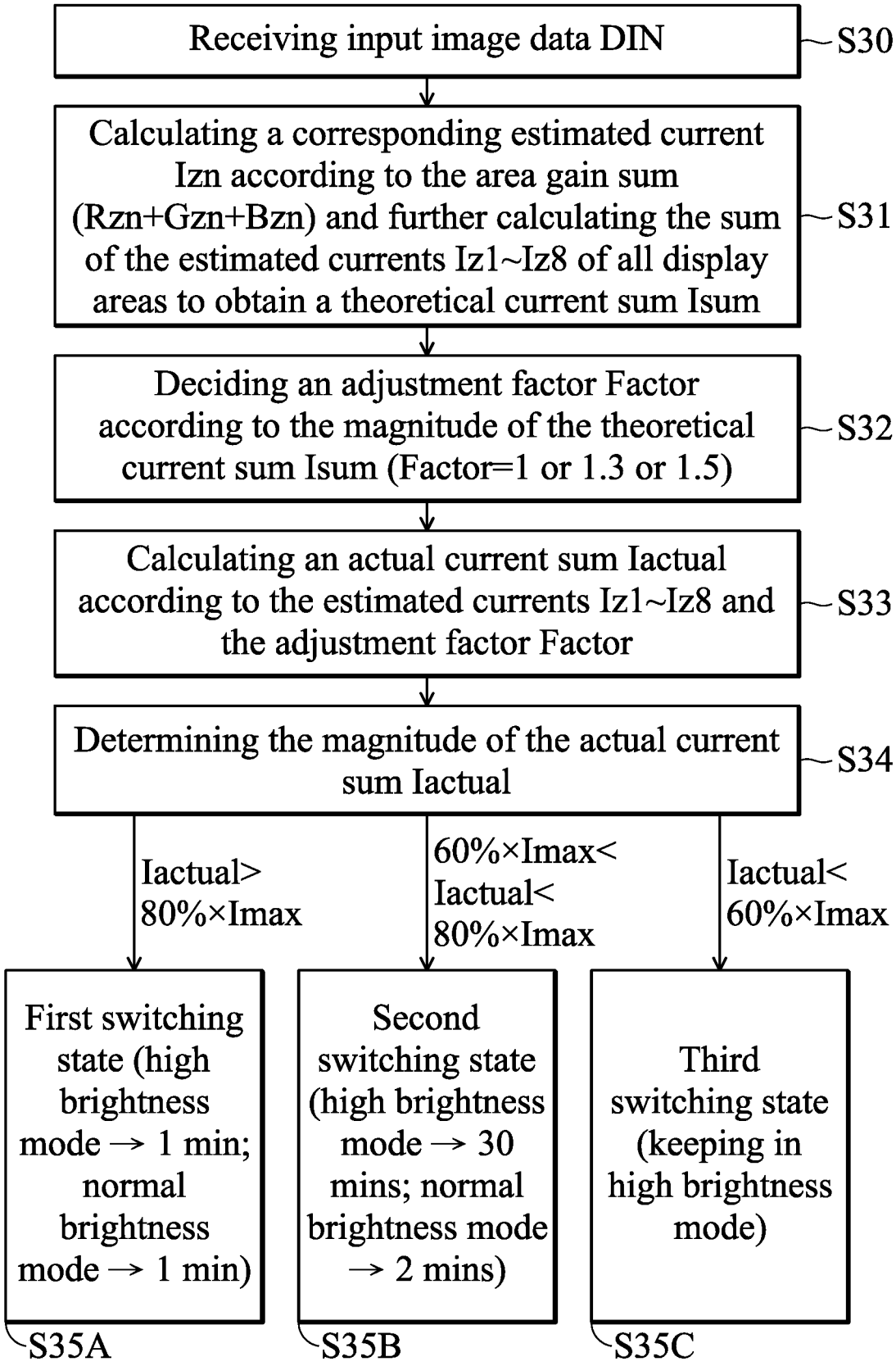
FIG. 3 shows an exemplary embodiment of a backlight driving method.

FIG. 3 shows an exemplary embodiment of a backlight driving method. The backlight driving method will be described below with reference to FIGS. 1 to 3. The backlight driving method of FIG. 3 is applied for driving the backlight module 13 of the display device 1. The backlight driving method begins at step S30. The image processing circuit 11 of the display device 1 receives input image data DIN through the input interface 10. The content of the input video data DIN includes the brightness gains of a plurality of colors of each pixel unit. For example, the content of the input video data DIN includes a red brightness gain, a green brightness gain, and a blue brightness gain of each pixel unit.

After the image processing circuit 11 receives the input video data DIN, the theoretical-current calculation circuit 20 of the image processing circuit 11 calculates a corresponding estimated current Izn according to the sum Rzn of the red brightness gains, the sum Gzn of the green brightness gains, and the sum Bzn of the blue brightness gains of each display area of the display panel 14 and further calculates the sum of the estimated currents Iz1~Iz8 of all the display areas to obtain the theoretical current sum Isum (step S31). In detail, the theoretical-current calculation circuit 20 calculates the estimated current Izn of each display area based on the above Formula (1).

Next, at the step 32, the adjustment-factor determination circuit 21 decides the adjustment factor Factor according to the magnitude of the theoretical current sum Isum. When it is determined that the theoretical current sum Isum is larger than (80%×Imax), the adjustment-factor determination circuit 21 decides that the adjustment factor Factor has a value of 1 (Factor=1). When it is determined that the theoretical current sum Isum is smaller than (80%×Imax) and larger than (60%×Imax), the adjustment-factor determination circuit 21 decides that the adjustment factor Factor has a value of 1.3 (Factor=1.3). When it is determined that the theoretical current sum Isum is less than (60%×Imax), the adjustment-factor determination circuit 21 decides that the adjustment factor Factor has a value of 1.5 (Factor=1.5).

After deciding the value of the adjustment factor Factor, the actual-current calculation circuit 22 calculates the actual current sum Iactual according to the estimated currents Iz1~Iz8 and the adjustment factor Factor (step S33). In detail, the actual-current calculation circuit 22 calculates the sum of the products which are obtained by multiplying each of the estimated currents Iz1~Iz8 with the adjustment factor Factor to obtain the actual current sum Iactual according to the above Formula (3).

At the following step S34, the state determination circuit 23 determines the magnitude of the actual current sum Iactual. When it is determined that the actual current sum Iactual is larger than (80%×Imax), the state determination circuit 23 generates the mode signal Smod to indicate the first switching state (step S35A). In the first switching state, the backlight controller 12 alternately operates in the normal brightness mode and the high brightness mode. According to one embodiment, in the first switching state, the duration in which the backlight controller 12 operates in the high brightness mode each time is 1 minute, and the duration in which the backlight controller 12 operates in the normal brightness mode each time is 1 minute.

When it is determined that the actual current sum Iactual is smaller than (80%×Imax) and larger than (60%×Imax), the state determination circuit 23 generates the mode signal Smod to indicate the second switching state (step S35B). In the second switching state, the backlight controller 12 alternately operates in the normal brightness mode and the high brightness mode. According to one embodiment, in the first switching state, the duration in which the backlight controller 12 operates in the high brightness mode each time is 30 minutes, and the duration in which the backlight controller 12 operates in the normal brightness mode each time is 2 minutes.

When it is determined that the actual current sum Iactual is smaller than (60%×Imax), the state determination circuit 23 generates the mode signal Smod to indicate the third switching state (step S35C). In the third switching state, the backlight controller 12 continuously operates in the high brightness mode, and the backlight controller 12 does not switch to the normal brightness mode.

In each of the switching states at the above steps S35A-S35C, when the backlight controller 12 operates in the normal brightness mode, the actual-current calculation circuit 22 generates the control signals S11-1~S11-8 respectively according to the estimated currents Iz1~Iz8 (not adjusted) and further according to the mode signal Smode. The backlight controller 12 generates the corresponding driving signals S12-1~S12-8 according to the control signals S11-1~S11-8 to drive the light source units 13-1~13-8, respectively.

Moreover, in each of the switching states at the above steps S35A-S35C, when the backlight controller 12 operates in the high brightness mode, the actual-current calculation circuit 22 generates the control signals S11-1~S11-8 respectively according to the actual currents Iz1'~ Iz8' (adjusted) and further according to the mode signal Smode. The backlight controller 12 generates the corresponding driving signals S12-1~S12-8 according to the control signals S11-1~S11-8 to drive the light source units 13-1~13-8, respectively. Therefore, it can be known that, in the high brightness mode, the actual-current calculation circuit 22 changes the control signals S11-1~S11-8 according to the adjustment factor Factor and the backlight controller 12 adjusts the driving signal S12-1~S12-8 according to the changed the control signal S11-1~S11-8. Since the adjustment factor Factor is greater than or equal to 1, the driving signals S12-1~S12-8 (ie, the actual currents Iz1'~Iz8') become larger in the high brightness mode. Therefore, the driven light source units 13-1~13-8 can emit light with higher brightness to meet the requirements of high dynamic range imaging (HDR) technology. In addition, the duration of the high brightness mode may have different lengths depending on the actual current sum Iactual. Therefore, when the display device 1 of the disclosed embodiment supports HDR technology, the problem of thermal (for example, overheating) can be avoided through the proper switching of the brightness modes.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device comprising:

a display panel comprising a plurality of pixel units and divided into a plurality of display areas;

an image processing circuit receiving input image data and generating a plurality of control signals according to the input image data;

a backlight controller receiving the plurality of control signals from the image processing circuit and generating a plurality of driving signals according to the plurality of received control signals respectively; and a light source module comprising a plurality of light source units corresponding to the plurality of display areas respectively, wherein the plurality of light source units are controlled respectively by the plurality of driving signals to emit light;

wherein each pixel unit comprises a first color brightness gain and a second color brightness gain, and the input image data comprises the first color brightness gains and the second color brightness gains of the plurality of pixel units, wherein for each of the plurality of display areas, the image processing circuit obtains an estimated current according to a sum of the first color brightness gains and the second color brightness gains of the pixel units in the display area, wherein the image processing circuit decides an adjustment factor according to a sum of the estimated currents of all of the plurality of display areas, and wherein when the backlight controller operates in a high brightness mode, the image processing circuit changes the plurality of control signals according to the adjustment factor, such that the backlight controller adjusts the plurality of driving signals according to the plurality of changed control signals.

2. The display device as claimed in claim 1, wherein for each of the plurality of light source units, when the backlight controller operates in a normal brightness mode, the image processing circuit generates the corresponding control signal according to the estimated current of the corresponding display area, and the backlight controller provides a driving current, which is equal to the corresponding estimated current, according to the corresponding control signal to serve as the corresponding driving signal.

3. The display device as claimed in claim 1, wherein the image processing circuit calculates an actual current sum according to the estimated currents of the plurality of display areas and the adjustment factor and decides a duration in which the backlight controller operates in the high brightness mode according to a magnitude of the actual current sum.

4. The display device as claimed in claim 3, wherein the image processing circuit determines the magnitude of the actual current sum, wherein when the image processing circuit determines that the actual current sum is larger than an upper threshold value, the image processing circuit decides that the duration is a first period, wherein when the image processing circuit determines that the actual current sum is smaller than the upper threshold value, the image processing circuit decides that the duration is a second period, and wherein the first period is shorter than the second period.

5. The display device as claimed in claim 4, wherein when the image processing circuit determines that the actual current sum is smaller than the upper threshold value and larger than a lower threshold value, the image processing circuit decides that the duration is the second period, wherein when the image processing circuit determines that the actual current sum is smaller than the lower threshold value, the image processing circuit decides that the duration is a third period, and wherein the second period is shorter than the third period.

6. The display device as claimed in claim 1, wherein the image processing circuit calculates the sum of the estimated currents of all of plurality of the display areas to obtain a theoretical current sum and determines a magnitude of the theoretical current sum, wherein when the image processing circuit determines that the theoretical current sum is larger than an upper threshold value, the image processing circuit decides that the adjustment factor has a first value, wherein when the image processing circuit determines that the theoretical current sum is smaller than the upper threshold value, the image processing circuit decides that the adjustment factor has a second value, and wherein the first value is smaller than the second value.

7. The display device as claimed in claim 6, wherein when the image processing circuit determines that the theoretical current sum is smaller than the upper threshold value and larger than a lower threshold value, the image processing circuit decides that the adjustment factor has the second value, wherein when the image processing circuit determines that the theoretical current sum is smaller than the lower threshold value, the image processing circuit decides that the adjustment factor has a third value, and wherein the second value is smaller than the third value.

8. The display device as claimed in claim 1, wherein for each of the plurality of display areas, the image processing circuit calculates a sum of the first color gains and the second color gains of the pixel units in the display area to generate an area gain sum, and wherein for each of the plurality of display areas, the image processing circuit calculates a product of a ratio of the area gain sum to a maximum gain sum and a default area current to obtain the corresponding estimated current.

9. The display device as claimed in claim 1, wherein for each of the plurality of light source units, when the backlight controller operates in the high brightness mode, the image processing circuit generates the corresponding control signal according to a product of the corresponding estimated current and the adjustment factor, and the backlight controller provides a driving current, which is equal to the a product of the corresponding estimated current and the adjustment factor, according to the corresponding control signal to serve as the corresponding driving signal.

10. The display device as claimed in claim 9, wherein for each of the plurality of light source units, when the backlight controller operates in a normal brightness mode, the image processing circuit generates the corresponding control signal according to the corresponding estimated current without the adjustment factor.

11. A backlight driving method for a display device, the display device comprising a display panel and a backlight module, the display panel comprising a plurality of pixel units and divided into a plurality of display areas, the light source module comprising a plurality of light source units corresponding to the plurality of display areas, and the backlight driving method comprising:

receiving input image data, wherein each pixel unit comprises a first color brightness gain and a second color brightness gain, and the input image data comprises the first color brightness gains and the second color brightness gains of the plurality of pixel units;

obtaining an estimated current according to a sum of the first color brightness gains and the second color brightness gains of the pixel units in each of the plurality of display areas;

deciding an adjustment factor according to a sum of the estimated currents of all of the plurality of display areas;

for each light source unit of the backlight module, generating a driving signal according to the corresponding estimated current to drive the light source unit to emit light; and in a high brightness mode, for each of the plurality of light source units, adjusting the corresponding driving signal and driving the light source unit by the adjusted driving signal to emit light.

12. The backlight driving method as claimed in claim 11 further comprising:

for each of the plurality of light source units, in a normal brightness mode, providing a driving current, which is equal to the corresponding estimated current, to serve as the corresponding driving signal.

13. The backlight driving method as claimed in claim 11 further comprising:

calculating an actual current sum according to the estimated currents of the plurality of display areas and the adjustment factor; and deciding a duration of the high brightness mode according to a magnitude of the actual current sum.

14. The backlight driving method as claimed in claim 13, wherein deciding the duration of the high brightness mode according to the magnitude of the actual current sum comprises:

determining the magnitude of the actual current sum;

when it is determined that the actual current sum is larger than an upper threshold value, deciding that the duration is a first period; and when it is determined that the actual current sum is smaller than the upper threshold value, deciding that the duration is a period which is longer than the first period.

15. The backlight driving method as claimed in claim 14, wherein when it is determined that the actual current sum is smaller than the upper threshold value, deciding that the duration is the period which is longer than the first period comprises:

when it is determined that the actual current sum is smaller than the upper threshold value and larger than a lower threshold value, deciding that the duration is a second period;

when it is determined that the actual current sum is smaller than the lower threshold value, deciding that the duration is a third period, wherein the third period is longer than the second period, the second period is longer than the first period.

16. The backlight driving method as claimed in claim 11, wherein deciding the adjustment factor according to the sum of the estimated currents of all of the plurality of display areas comprises:

calculating the sum of the estimated currents of all of plurality of the display areas to obtain a theoretical current sum;

determining a magnitude of the theoretical current sum;

wherein when it is determined that the theoretical current sum is larger than an upper threshold value, deciding that the adjustment factor has a first value; and wherein when it is determined that the theoretical current sum is smaller than the upper threshold value, deciding that the adjustment factor has a value which is larger than the first value.

17. The backlight driving method as claimed in claim 16, wherein when it is determined that the theoretical current sum is smaller than the upper threshold value, deciding that the adjustment factor has the value which is larger than the first value comprises:

when it is determined that the theoretical current sum is smaller than the upper threshold value and larger than the lower threshold value, the image processing circuit decides that the adjustment factor has a second value; and when it is determined that the theoretical current sum is smaller than the lower threshold value, the image processing circuit decides that the adjustment factor has a third value, wherein the third value is larger than the second value, and the second value is smaller than the first value.

18. The backlight driving method as claimed in claim 11, wherein obtaining the estimated current according to the sum of the first color brightness gains and the second color brightness gains of the pixel units in each of the plurality of display areas comprises:

for each of the plurality of display areas, calculating a sum of the first color gains and the second color gains of the pixel units in the display area to generate an area gain sum; and for each of the plurality of display areas, calculating a product of a ratio of the area gain sum to a maximum gain sum and a default area current to obtain the corresponding estimated current.

19. The backlight driving method as claimed in claim 11, wherein in the high brightness mode, for each of the plurality of light source units, adjusting the corresponding driving signal according to the adjustment factor and driving comprises:

providing a driving current, which is equal to the a product of the corresponding estimated current and the adjustment factor, to serve as the corresponding driving signal.

20. The backlight driving method as claimed in claim 19, wherein for each of the plurality of light source units, in a normal brightness mode, the corresponding driving signal is not affected by the adjustment factor.

* * * * *